US006686839B2

(12) United States Patent
Chou et al.

(10) Patent No.: US 6,686,839 B2
(45) Date of Patent: Feb. 3, 2004

(54) METHOD AND SYSTEM FOR NOISE NOTIFICATION

(75) Inventors: Paul Bao-Luo Chou, Montvale, NJ (US); Marco O. Gruteser, Yorktown Heights, NY (US); Jennifer C. Lai, Garrison, NY (US); Anthony Levas, Yorktown Heights, NY (US); Paul Andrew Moskowitz, Yorktown Heights, NY (US); Danny Chan Yong Wong, Allendale, NJ (US)

(73) Assignee: International Business Machines Corporation, Armonk, NY (US)

( * ) Notice: Subject to any disclaimer, the term of this patent is extended or adjusted under 35 U.S.C. 154(b) by 174 days.

(21) Appl. No.: 09/824,673

(22) Filed: Apr. 4, 2001

(65) Prior Publication Data

US 2002/0145521 A1 Oct. 10, 2002

(51) Int. Cl.[7] ..... G08B 21/00

(52) U.S. Cl. ..... 340/540; 340/332; 340/573.1; 340/815.65; 381/56; 704/246

(58) Field of Search ..... 340/540, 331, 340/332, 531, 815.4, 815.65, 573.1; 381/56, 58, 110; 704/246

(56) References Cited

U.S. PATENT DOCUMENTS

| | | | | | |
|---|---|---|---|---|---|
| 3,582,671 | A | | 6/1971 | Ott | 307/117 |
| 3,661,224 | A | * | 5/1972 | Allen et al. | 73/647 |
| 3,667,138 | A | * | 6/1972 | Cohen | 434/185 |
| 3,913,081 | A | * | 10/1975 | Bollinger et al. | 340/683 |
| 4,122,432 | A | * | 10/1978 | Triebold et al. | 367/135 |
| 4,424,511 | A | | 1/1984 | Alberts, Jr. | 340/500 X |
| 5,400,011 | A | * | 3/1995 | Sutton | 340/566 |
| 5,778,077 | A | | 7/1998 | Davidson | 381/57 |
| 5,971,913 | A | * | 10/1999 | Newkirk et al. | 600/22 |
| 6,421,644 | B1 | * | 7/2002 | Okitsu | 704/270.1 |
| 2002/0169614 | A1 | * | 11/2002 | Fitzpatrick et al. | 704/270.1 |

* cited by examiner

*Primary Examiner*—Thomas Mullen
(74) *Attorney, Agent, or Firm*—Stephen C. Kaufman, Esq.; McGinn & Gibb, PLLC

(57) ABSTRACT

A system (and method) includes a sound monitoring system, a detector for identifying a source of the sound, a computing system for processing the sound to trigger a notification event, and a user interface system for notifying at least one individual responsible for the sound.

35 Claims, 3 Drawing Sheets

METHOD AND SYSTEM FOR NOISE NOTIFICATION

BACKGROUND OF THE INVENTION

1. Field of the Invention

The present invention generally relates to a system and method for noise notification, and more particularly to a system and method for identification of noise sources and subsequent notification to the noise sources.

2. Description of the Related Art

A frequent complaint by office workers about their work environment is that it is too noisy. Much of the noise is created by the workers themselves in the course of their work. However, the noise is not always intentional, nor are they necessarily aware that they are speaking too loudly or making noise in any other way. Noise indicating light systems are known. However, none of these systems directs notification to the person responsible for the noise.

Thus, a method must be found to identify individuals as noise sources and to notify them (or a person responsible for them such as a manager or the like) that they are creating too much noise. Hitherto, the present invention such a method and system have been unknown, nor has such a problem even been identified.

SUMMARY OF THE INVENTION

In view of the foregoing and other problems, drawbacks, and disadvantages of the conventional methods and structures, an object of the present invention is to provide a method and structure in which noise sources are identified and subsequent notification occurs to such noise sources.

In a first aspect of the present invention, a system includes a sound monitoring system, a detector for identifying a source of the sound, a computing system for processing the sound to trigger a notification event, and a user interface system for notifying at least one individual responsible for the sound. The person may be responsible for the sound by conversing loudly, having a loud phone conversation or by playing a loud electronic device (e.g., radio, computer sound system, game, electronic audio system, etc.).

With the invention, direct notification is provided to the person responsible for the noise (or to another person such as a manager or supervisor, or co-worker of the noise maker), thereby allowing remedial action to be taken by the noise maker to reduce the level of noise in the environment of interest.

BRIEF DESCRIPTION OF THE DRAWINGS

The foregoing and other purposes, aspects and advantages will be better understood from the following detailed description of a preferred embodiment of the invention with reference to the drawings, in which.

DETAILED DESCRIPTION OF PREFERRED EMBODIMENTS OF THE INVENTION

Figure 1:
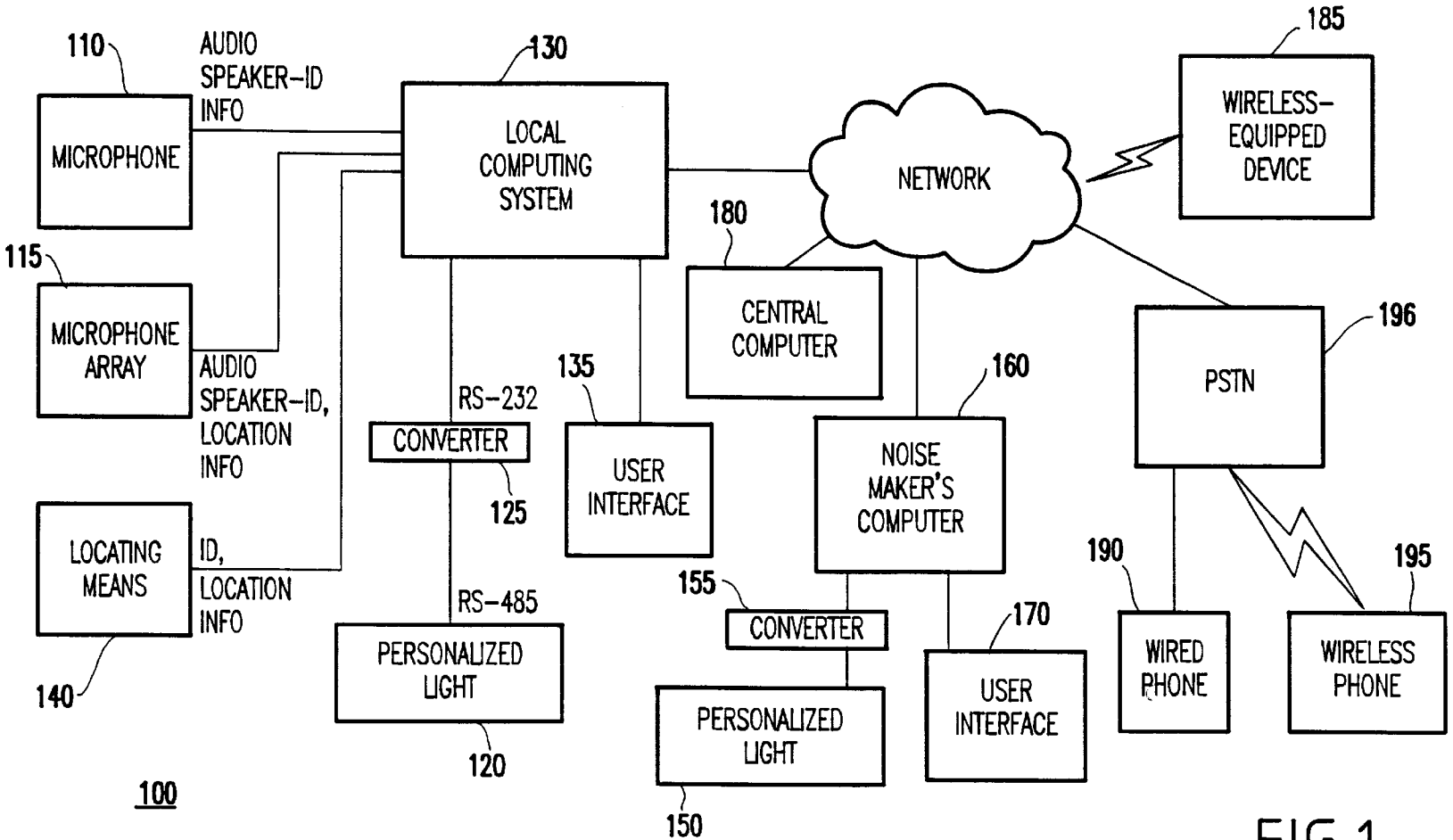
FIG. 1 illustrates a system 100 according to the present invention.

Referring now to the drawings, and more particularly to FIGS. 1–4, there are shown preferred embodiments of the method and structures according to the present invention.

Preferred Embodiment

Turning to FIG. 1, a system 100 is shown for noise notification. Generally, sound (noise) is recorded using a microphone 110 or the like as an input device, and is digitized (e.g., at some predetermined sampling rate and encoding scheme). It is noted that the location and the approximate range of the microphone are known in advance. Thus, the approximate location of the source of the sound (e.g., the noise maker) can be detected based on the known location of the microphone. Further, the identification of the noise maker can be detected since the microphone can be made personal to a user (e.g., placed on the desk of the user).

Thereafter, samples are processed to measure loudness (e.g., each sample is squared, then summed and finally normalized by the number of summed samples. Samples may be taken over a given interval of time). This yields a number that indicates the average loudness (L) for that interval of time. A plurality of parameters are used as thresholds for determining whether notification should be sent that sound levels are exceeded.

It is noted that a first parameter is the Noise Loudness Threshold (NLT) and a second parameter is the duration of time (T) that this level was exceeded. A simple algorithm uses these two thresholds to determine that the noise level is exceeded for some duration of time. Hence, for example, a person may be allowed to shout for 10 seconds, but not for 3 minutes. Thus, criteria can be set such as functions of time and loudness.

Thereafter, a notification event is triggered.

Regarding notification events, as further shown in the system diagram of FIG. 1, a "personalized" light 120 is shown. For purposes of the present invention, "personalized" means that the light is located in a certain location (e.g., cubicle, etc.) typically associated with a potential noise maker. In an alternative embodiment, one lamp is visible to a group of people. Each person has a specific color assigned (e.g., red for Jennifer, blue for Paul, etc.). A flashing blue light may then mean that Paul is the source of the noise.

A local computer 130 uses an audio input from the microphone 110, along with speaker identification technology (e.g., speech recognition technology as is believed to be well-known in the art), to locate the noisy individual, or an array of microphones 115 is used to locate the source of the sound and the person (or people) at that location.

Additional location and personal identification (ID) may be obtained through the use of a locating device 140. For example, the locating device may take the form of a wireless radio frequency identification (RFID) badge such as a Xyloc® manufactured by Ensure Technologies Corporation.

Alternatively, the ID may be provided by a wireless-equipped device carried by the potential noisy individual such as, for example, a Bluetooth-equipped device, a cellular phone, a personal data assistant (PDA), or a laptop computer.

Noise notification is accomplished through audio or display outputs such as through the use of a color-controllable lamp 150, preferably color-coded for each individual, as mentioned above. The color-coded lamp may be located in the specific noise maker's location (e.g., cubicle, etc.) or sent to him via a communication mechanism (e.g., via e-mail or instant, "pop-up" message sent to the noise maker's computer, PDA, or cellular telephone).

To effect notification, the lamp 150 may change in color, intensity, or may flash (e.g., be pulsed). The noise detection and notification algorithms preferably are implemented in Java®. Sound data is obtained through the Java® Sound Application Programming Interface (API) from Sun Microsystems' Java® 1.3 and the separately available Java® Communications API is used to control the light through the serial port.

The lamp color displayed may be coded for different types of noise (e.g., a phone ring "blue", a human voice—"red", loud music—"purple", . . . etc.). Users may have profiles which indicate their preferred mode of notification. These profiles may reside on individual computers or on a central computer coupled to a computer network.

FIG. 1 also shows a converter (e.g., RS-232 converter) 125 between the personalized light 120 and the local computing system 130, as well as a user interface 135 for the local computing system 130.

Regarding a Local Computer User Interface 135, the scenario begins as described above using a personalized light 120. Then, the noisy individual is notified by a user interface 170 of the individual's (noise maker's) computer 160. The user interface 170 may be a display or an audio output. There is also a converter 155 between the personal light 150 and the noise maker's computer 160. Additionally, there is a central computer 180 attached to the network (not referenced).

Regarding Network Notification, if the identified noise maker is not the owner of the local computer that processes the audio, then notification may be achieved through the use of a network connection. The network may be an intranet, the Internet, a local area network, or a telephone network.

In one exemplary scenario, assume that Danny's computer determines that the source of the noise is Tony who works in the next office. If perhaps the microphone 110 in Tony's office is not functioning properly, then Tony is not notified by his computer.

Instead, notification is sent over the network from Danny's computer to Tony's computer and notification is provided by the personalized light 150 or by the user interface 170 of Tony's computer. Alternatively, if Paul is the noise creator, but is only visiting in the vicinity of Danny's office, Paul may be notified by one of his wireless-equipped devices 185 (e.g., a PDA or laptop with Bluetooth or IEEE 802.11 connection or a pager) or by a phone call to a wired phone 190 in the area of Paul's location or to his cell phone 195 via a public switched telephone network (PSTN) 196.

The notification also may be to the computer-controlled user interface device nearest to Paul's current position.

Additionally, the person notified may be asked to acknowledge the notification. This may be accomplished through the use of a computer user interface 170, or by means of a wired phone 190, a wireless phone 195, or a wireless equipped device 185. Once the acknowledgment has been received by the computing system controlling the means of notification described above, the notification may be stopped.

It is noted that regarding the notification via personalized light, the invention may be implemented with a Sony (ECM-55B) Electret Condenser Microphone, an IBM(M Pro) IntelliStation and Color Kinetics (Model BL-001) light.

To control the above example of a personalized light, an IBM IntelliStation is used. A converter is used to convert the RS-232 Intellistation interface to the RS-485 light interface. The light provides 512 discrete colors.

The colors can be used as a warning indicator. For example, in one scenario, the system is adaptive in that, at a certain noise level, the degree of notification (e.g., color) may change as the volume and/or duration of the sound changes. Along these lines, for example, if the noise has a certain level, the lamp may be lit to green, and if the volume gets higher it turns to orange, and finally if it gets even more loud, the lamp changes to red.

Figure 2:
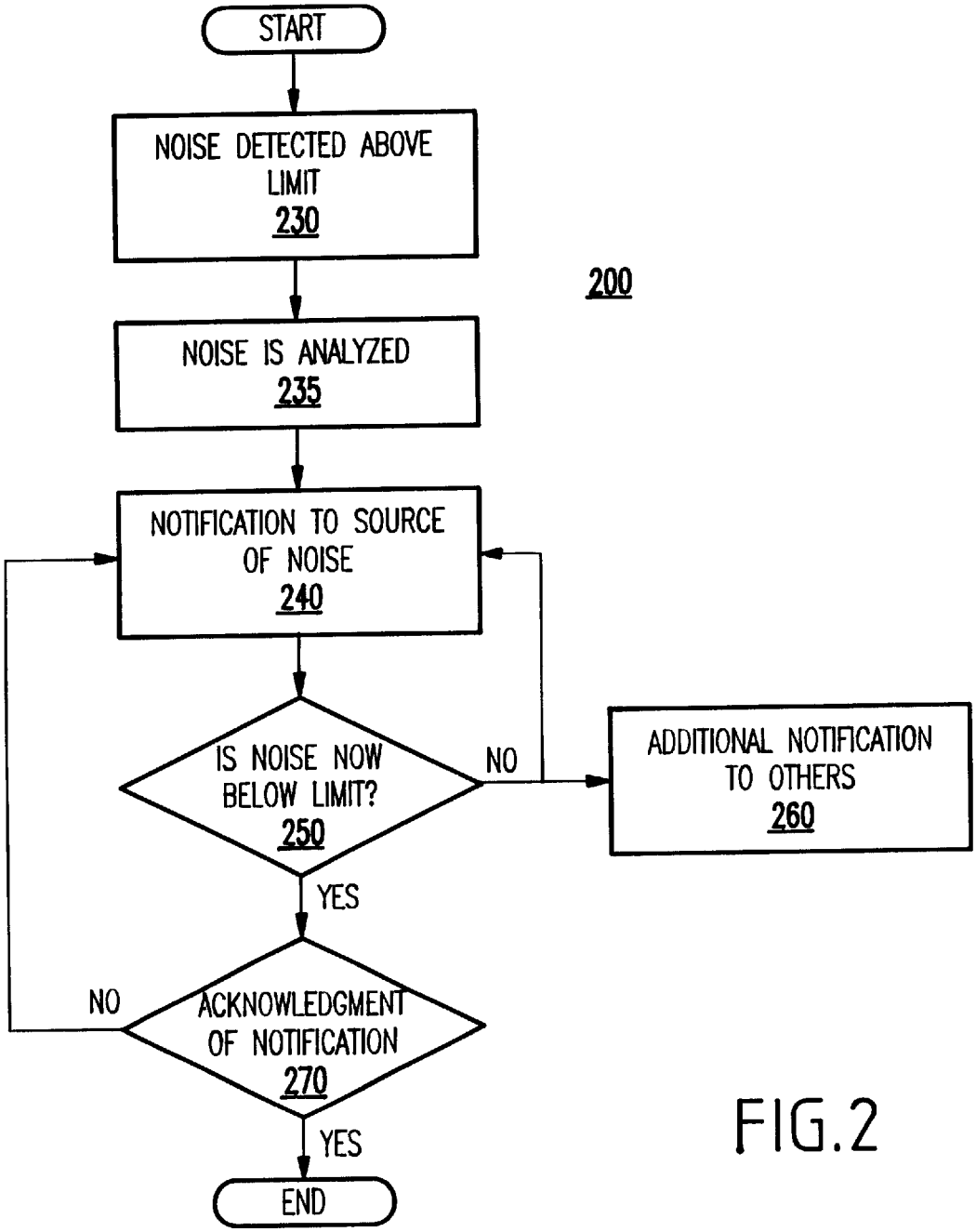
FIG. 2 illustrates a method 200 for noise notification according to a preferred embodiment of the present invention.

Turning now to FIG. 2, a method 200 of the present invention is described and which has been alluded to above.

That is, in step 230, it is detected that a noise from a noise source is above a predetermined limit (threshold).

Then, in step 235, the noise is analyzed as described above.

In step 240, a notification is made in the manner described above to the source of the noise (e.g., the noise maker).

In step 250, a new analysis is made regarding whether the noise is now below the predetermined limit. If "NO", the process loops back to step 240 for another notification and/or additional notification is sent to others in step 260.

Additionally, an acknowledgment that the notification has been received may be required as shown in step 270. The acknowledgment may be generated by the person who has been identified as the source of the noise or by one of the others notified in step 260. The others of step 260 may include someone who shares responsibility for the noise making person such as the manager or supervisor of the person responsible for the noise or the other person may be a co-worker (e.g., a noise control officer or a person who works in the same group). If "NO", then the process loops back for further notification 240, analysis 250 and/or notification to others 260. Step 270 may be used in sequence with step 250 as shown or in place of step 250.

If "YES" in step 270, then the process ends.

Figures 3, 4:
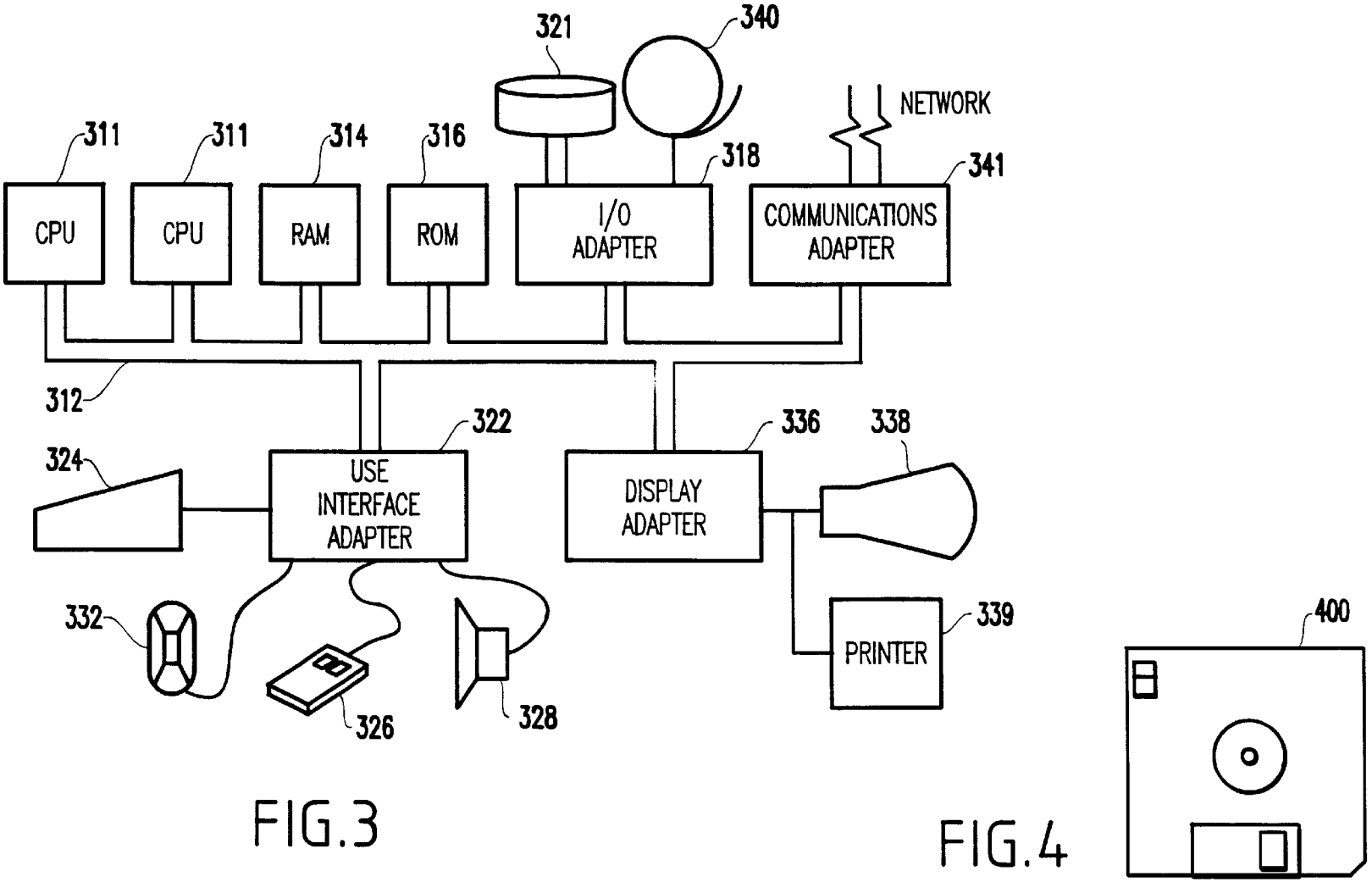
FIG. 3 illustrates an exemplary hardware/information handling system 300 for incorporating the present invention therein.
FIG. 4 illustrates a signal bearing medium (e.g., storage medium) 400 for storing steps of a program for noise notification according to the present invention.

FIG. 3 illustrates a typical hardware configuration of an information handling/computer system which can be used with the invention and which preferably has at least one processor or central processing unit (CPU) 311.

The CPUs 311 are interconnected via a system bus 312 to a random access memory (RAM) 314, read-only memory (ROM) 316, input/output (I/O) adapter 318 (for connecting peripheral devices such as disk units 321 and tape drives 340 to the bus 312), user interface adapter 322 (for connecting a keyboard 324, mouse 326, speaker 328, microphone 332, and/or other user interface device to the bus 312), a communication adapter 334 for connecting an information handling system to a data processing network, the Internet, an intranet, a personal area network (PAN), etc., and a display adapter 336 for connecting the bus 312 to a display device 338 and/or printer 339.

Thus, as shown in FIG. 3 in addition to the hardware and process environment described above, a different aspect of the invention includes a computer-implemented method according to the present invention, as described above. As an example, this method may be implemented in the particular hardware environment discussed above.

Such a method may be implemented, for example, by operating the CPU 311 (FIG. 3), to execute a sequence of machine-readable instructions. These instructions may reside in various types of signal-bearing media.

Thus, this aspect of the present invention is directed to a programmed product, comprising signal-bearing media tangibly embodying a program of machine-readable instructions executable by a digital data processor incorporating the CPU 311 and hardware above, to perform the method of the invention.

This signal-bearing media may include, for example, a RAM contained within the CPU 311, as represented by the fast-access storage for example. Alternatively, the instructions may be contained in another signal-bearing media, such as a magnetic data storage diskette 400 (FIG. 4), directly or indirectly accessible by the CPU 311.

Whether contained in the diskette 400, the computer/CPU 311, or elsewhere, the instructions may be stored on a variety of machine-readable data storage media, such as DASD storage (e.g., a conventional "hard drive" or a RAID array), magnetic tape, electronic read-only memory (e.g., ROM, EPROM, or EEPROM), an optical storage device (e.g. CD-ROM, WORM, DVD, digital optical tape, etc.), paper "punch" cards, or other suitable signal-bearing media including transmission media such as digital and analog and communication links and wireless. In an illustrative embodiment of the invention, the machine-readable instructions may comprise software object code, compiled from a language such as "C", etc.

Thus, as described above, the present invention provides a noise identification and notification system which is computerized, aimed at a single individual (e.g., provides personal notification to the offender), and is connected to a network. Thus, the invention can minimize the noise created in an office environment by detecting the source of the noise and then attendantly notifying the noise maker accordingly that they are creating too much noise.

While the invention has been described in terms of several preferred embodiments, those skilled in the art will recognize that the invention can be practiced with modification within the spirit and scope of the appended claims.

What is claimed is:

1. A system, comprising:

a sound monitoring system;

a detector for identifying a source of the sound;

a computing system for processing the sound to trigger a notification event; and a user interface system for notifying at least one individual responsible for the sound, wherein said computing system performs said processing when an amount of noise associated with said sound is determined to be greater than a predetermined threshold, wherein the individual notified is the source of the sound.

2. The system of claim 1, wherein said sound monitoring system comprises a microphone array.

3. The system of claim 1, wherein the source of said sound is identified by a speaker identification system.

4. The system of claim 1, further comprising: a locator for determining a location of the sound.

5. The system of claim 1, wherein the source of the sound comprises one of a conversation, a phone conversation, a radio, a computer sound system, a game, and an electronic audio system.

6. The system of claim 1, wherein said computer network comprises one of an intranet, the Internet, a local area network, and a telephone network.

7. The system of claim 1, wherein said user interface system comprises a personalized light.

8. The system of claim 1, wherein said personalized light is made to at least one of flash, exhibit a specific color, and change intensity.

9. The system of claim 7, wherein a color of said personalized light indicates at least one of a sound source and a level of said sound.

10. The system of claim 1, wherein said user interface system comprises a computer user interface.

11. The system of claim 1, wherein said user interface system includes at least one of a display and an audio output.

12. The system of claim 1, wherein the computer network is connected to at least one of a pager, a cellular phone, a wired phone, and a wireless-equipped device.

13. The system of claim 12, wherein the wireless-equipped device comprises one of a Bluetooth device and an IEEE 802.11 device.

14. The system of claim 1, wherein said computing system stores a preferred method of notification to said at least one individual.

15. The system of claim 1, further comprising a network to which said computing system is coupled, and a central computer attached to said network, said central computer storing a preferred method of notification.

16. The system of claim 1, wherein said computing system measures a sound level.

17. The system of claim 1, wherein said computing system measures a duration of said sound.

18. The system of claim 1, wherein said computing system calculates said amount of noise based upon a level and a duration of said sound.

19. The system of claim 1, wherein said computing system receives an acknowledgment from said at least one individual.

20. A system, comprising:

a sound monitoring system;

a detector for identifying a source of the sound;

a computing system for processing the sound to trigger a notification event; and a user interface system for notifying at least one individual responsible for the sound, wherein said computing system performs said processing when an amount of noise associated with said sound is to be greater than a predetermined threshold, wherein the individual notified comprises one of a manager of the individual responsible for the sound, and a co-worker of the individual responsible for the sound.

21. A method, comprising:

monitoring sound in a predetermined area;

identifying a source of the sound;

processing, by a computing system, the sound to trigger a notification event, wherein said computing system is coupled to a computer network; and notifying at least one individual responsible for said sound, wherein the individual notified is the source of the sound.

22. The method of claim 21, further comprising:

determining a location of the sound.

23. The method of claim 21, wherein the notifying comprises illuminating a personalized light for the individual to observe.

24. The method of claim 23, wherein the personalized light is made to at least one of flash, exhibit a specific color, and change intensity.

25. The method of claim 21, wherein the notifying comprises at least one of displaying, on a display, a predetermined image to said individual and providing a predetermined audio output to said individual.

26. The method of claim 25, wherein a color on said display indicates at least one of a sound source and a type of said sound.

27. The method of claim 21, wherein said processing is performed when an amount of noise associated with said sound is greater than a predetermined threshold.

28. The method of claim 21, further comprising:

measuring a sound level.

29. The method of claim 21, further comprising:

measuring a duration of said sound.

30. The method of claim 21, wherein said processing comprises calculating a threshold based upon a level and a duration of said sound.

31. The method of claim 21, further comprising:

receiving an acknowledgment from said at least one individual.

32. A method, comprising:

monitoring sound in a predetermined area;

identifying a source of the sound;

processing, by a computing system, the sound to trigger a notification event, wherein said computing system is coupled to a computer network; and notifying at least one individual responsible for said sound, wherein the individual notified comprises one of a manager of the individual responsible for the sound, and a co-worker of the individual responsible for the sound.

33. A signal-bearing medium tangibly embodying a program of machine-readable instructions executable by a digital processing apparatus to perform a method of noise notification, said method comprising:

monitoring sound in a predetermined area;

identifying a source of the sound;

processing, by said digital processing apparatus, the sound to trigger a notification event, wherein said digital processing apparatus is coupled to a computer network; and notifying at least one individual responsible for said sound, wherein the individual notified is the source of the sound.

34. The signal-bearing medium according to claim 33, wherein said processing comprises calculating a threshold based upon a level and a duration of said sound.

35. A signal-bearing medium tangibly embodying a program of machine-readable instructions executable by a digital processing apparatus to perform a method of noise notification, said method comprising:

monitoring sound in a predetermined area;

identifying a source of the sound;

processing, by said digital processing apparatus, the sound to trigger a notification event, wherein said digital processing apparatus is coupled to a computer network; and notifying at least one individual responsible for said sound, wherein the individual notified comprises one of a manager of the individual responsible for the sound, and a co-worker of the individual responsible for the sound.

* * * * *